US009038642B2

(12) United States Patent
Liu

(10) Patent No.: US 9,038,642 B2
(45) Date of Patent: May 26, 2015

(54) ELECTRONIC CIGARETTE

(71) Applicant: Qiuming Liu, Shenzhen (CN)

(72) Inventor: Qiuming Liu, Shenzhen (CN)

(73) Assignee: HUIZHOU KIMREE TECHNOLOGY CO., LTD. SHENZHEN BRANCH, Shenzhen, Futian District (CN)

( * ) Notice: Subject to any disclaimer, the term of this patent is extended or adjusted under 35 U.S.C. 154(b) by 246 days.

(21) Appl. No.: 13/748,927

(22) Filed: Jan. 24, 2013

(65) Prior Publication Data

US 2014/0190501 A1 Jul. 10, 2014

(51) Int. Cl.
*A24F 47/00* (2006.01)

(52) U.S. Cl.
CPC ..... *A24F 47/008* (2013.01)

(58) Field of Classification Search
CPC ..... A24F 47/008
See application file for complete search history.

(56) References Cited

U.S. PATENT DOCUMENTS

| | | | | |
|---|---|---|---|---|
| 2004/0237976 | A1* | 12/2004 | Garthaffner | 131/274 |
| 2009/0283103 | A1* | 11/2009 | Nielsen et al. | 131/273 |
| 2010/0263681 | A1* | 10/2010 | Zhao | 131/173 |
| 2011/0155153 | A1* | 6/2011 | Thorens et al. | 131/329 |
| 2012/0186594 | A1* | 7/2012 | Liu | 131/329 |
| 2013/0019862 | A1* | 1/2013 | Yamada et al. | 128/200.21 |
| 2014/0060554 | A1* | 3/2014 | Collett et al. | 131/328 |

* cited by examiner

*Primary Examiner* — Richard Crispino
*Assistant Examiner* — Eric Yaary
(74) *Attorney, Agent, or Firm* — Steptoe & Johnson LLP

(57) ABSTRACT

An electronic cigarette is provided, comprising a cigarette rod (100) with smoke liquid and a battery, a cigarette holder (200) and a atomizer (300), the cigarette rod (100), the atomizer (300) and the cigarette holder (200) are connected successively, the battery provides power for the atomizer (300) to heat and atomize the smoke liquid, the atomized smoke liquid is discharged through the cigarette holder (200), wherein, a pressure-regulating valve component (400) is provided between the cigarette rod (100) and the atomizer (300) to adjust the flow of the smoke liquid, the pressure-regulating valve component is installed between the cigarette rod and the atomizer to control the flow of the smoke liquid of the electronic cigarette, enabling to adjust the amount of atomizing smoke liquid inhaled by user, and thus the taste of smoking can be adjusted to satisfy different users' need, and the tobacco bar inflows from the battery and control panel can be prevented to extend the life of the electronic cigarette.

4 Claims, 6 Drawing Sheets

ELECTRONIC CIGARETTE

CLAIM OF PRIORITY

This application claims priority to Chinese Application Serial No. 201320002876.0, filed Jan. 5, 2013, which is incorporated by reference in its entirety.

FIELD OF THE INVENTION

The present invention relates to the field of consumer electronic products technology, more particularly, relates to an electronic cigarette.

BACKGROUND OF THE INVENTION

People gradually come to realize tobacco is harmful for the health with a lot of interest in human health, so an electronic cigarette that can ease craving for tobacco and is less harmful to the health has been generated. The electronic cigarette is used to simulate the taste of smoking through atomizing the special smoke liquid by an atomizer. When producing the smoke liquid, the substances, which are harmful to human health such as nicotine, tar etc., are eliminated. Because of lacking of harmful substances such as nicotine, tar etc. which may make people dependent, the craving for tobacco will become smaller gradually after using electronic cigarette. Thus the electronic cigarette also has the effect of helping to stop smoking.

The existing electronic cigarette usually consists of a cigarette rod and a cigarette holder fixed connected to the cigarette rod. The cigarette rod is provided with a battery, and the cigarette holder is fitted with an atomizer. The cigarette rod is connected with the cigarette holder through a connecting member that is equipped with an air intake for inletting air. The atomized smoke liquid enters into the cigarette bolder through the air intake. As the diameter of the air intake is invariability; the flow of the smoke liquid passing the air intake is also invariability. Thus it is difficult to adjust the flow of the smoke liquid passing the air intake to regulate the taste of smoking when using the existing electronic cigarette.

SUMMARY OF THE INVENTION

The objective of the present invention is to provide an electronic cigarette which is using pressure-regulating valve technology, and can effectively improve the taste of smoking and adjust the smoking strength, aiming at the above-mentioned drawbacks of the laboriousness for smoking and difficulties in adjusting the taste of smoking.

The technical solutions of the present invention for solving the technical problems are as follows:

An electronic cigarette is provided, which comprises a cigarette rod with smoke liquid and a battery, a cigarette holder and a atomizer, the cigarette rod, the atomizer and the cigarette holder are connected successively, and the battery provides power for the atomizer to heat and atomize the smoke liquid, then the atomized smoke liquid is discharged through the cigarette holder, wherein, a pressure-regulating valve components is provided between the cigarette rod and the atomizer to adjust the flow of the smoke liquid.

Advantageously, the electronic cigarette further comprises a first support and a second support, and the pressure-regulating valve component is fixed with the cigarette rod and the atomizer respectively through the first support and the second support.

Advantageously, the pressure-regulating valve component comprises a first valve gland, a elastic part installed on the bottom of the first valve gland, a fixed part winded by the elastic part and a first support base for supporting the fixed part; the first valve gland is provided with several through-holes; the both ends of the first support base are open and the inside of the first support base is provided with several bulges apart from each other, and the fixed part is set to the bulges placed on the inside of the first support base.

Advantageously, the fixed part comprises a base and a body perpendicular to the base, the base is set to the bulges placed on the inside of the first support base, and the elastic part winds along the outside of the body.

Advantageously, the pressure-regulating valve component also comprises a first sealing part, the both sides of which are butting connected with the first valve gland, and the both ends of the first sealing part are open.

Advantageously, the body is inserted into a through-hole of the first valve gland, and is butting fixed with the both sides of the inner wall of the through-hole.

Advantageously, the pressure-regulating valve component also comprises a second valve gland with a through—hole at the top, a steel ball and the second support base, the both ends of the second support base are open and the inside of the second support base is provided with several bulges apart from each other, the steel ball is set to the bulges placed on the inside of the second support base.

Advantageously, the pressure-regulating valve components also comprises a second sealing part, the both sides of the second sealing part are butting connected with the second valve gland, and the both ends of the second sealing part are open.

Advantageously, the pressure-regulating valve components also comprises a third support base and a third valve sleeved on the inner of the third support base, the bottom of the third support base is provided with a through-hole, the inside of the third valve is provided with a connecting part that is corresponding to the through-hole, and one end of the connecting part is connected to the edge of the third valve and movable relative to the third valve.

Advantageously, the connecting part is a round thin sheet.

When implementing the electronic cigarette of the present invention, the following advantageous effects can be achieved: the pressure-regulating valve component is installed between the cigarette rod and the atomizer to control the flow of the smoke liquid of the electronic cigarette, enabling to adjust the amount of atomizing smoke liquid inhaled by user, and thus the taste of smoking can be adjusted to satisfy different users' need, and the tobacco bar inflows from the battery and control panel can be prevented to extend the life of the electronic cigarette.

BRIEF DESCRIPTION OF THE DRAWINGS

The present invention will be further described with reference to the accompanying drawings and embodiments in the following, in the accompanying drawings.

DETAILED DESCRIPTION OF THE PREFERRED EMBODIMENT

TO make the technical feature, objective and effect of the present invention be understood more clearly, now the specific implementation of the present invention is described in detail with reference to the accompanying drawings and embodiments.

Figure 1:
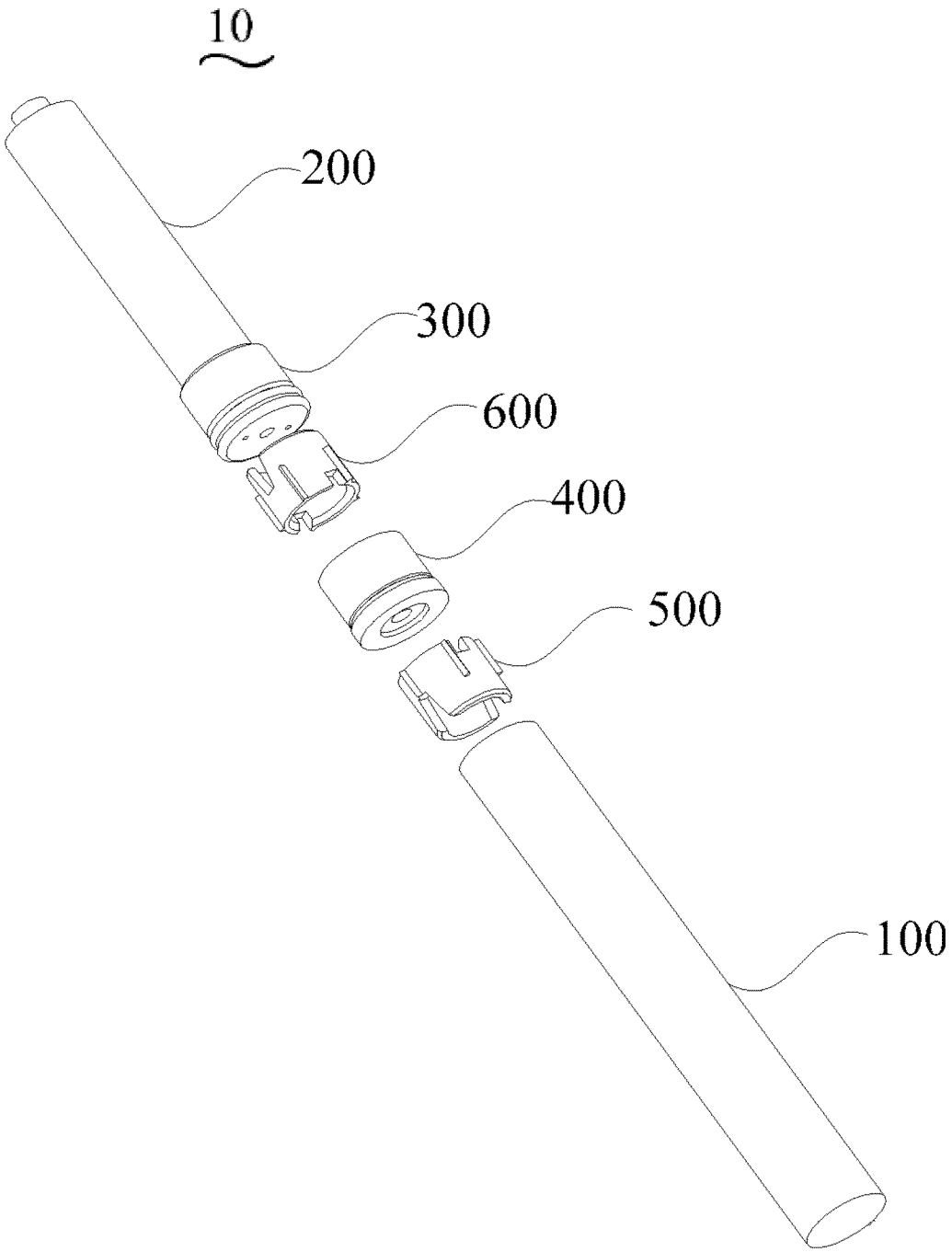
FIG. 1 is a segment diagram for a electronic cigarette of an embodiment in the present invention.

As shown in FIG. 1, the electronic cigarette 10 of the present invention comprises a cigarette rod 100 with smoke liquid and a battery, a cigarette holder 200, a atomizer 300, a pressure-regulating valve component 400, a first support 500 and a second support 600. The cigarette rod 100, the atomizer 300 and the cigarette holder 200 are connected successively, the battery provides power for the atomizer 300 to heat and atomize the smoke liquid, the atomized smoke liquid is vented from the cigarette holder 200. The pressure-regulating valve component 400 is used to adjust the taste pressure of the electronic cigarette and installed between the cigarette holder 100 and the atomizer 300, the pressure-regulating valve component 400 is fixed with the cigarette holder 100 through the first support 500, and is fixed with the atomizer 300 through the second support 600, and the shape of the first support 500 and the second support 600 are the same. In specific embodiments, the first support 500 and the second support 600 are designed as a hollow cylindrical structure with internal thread or external thread, and the first support 500 and the second support 600 are connected with the cigarette holder 100 and the atomizer 300 by a screw-closure manner

Embodiment 1

Figure 2:
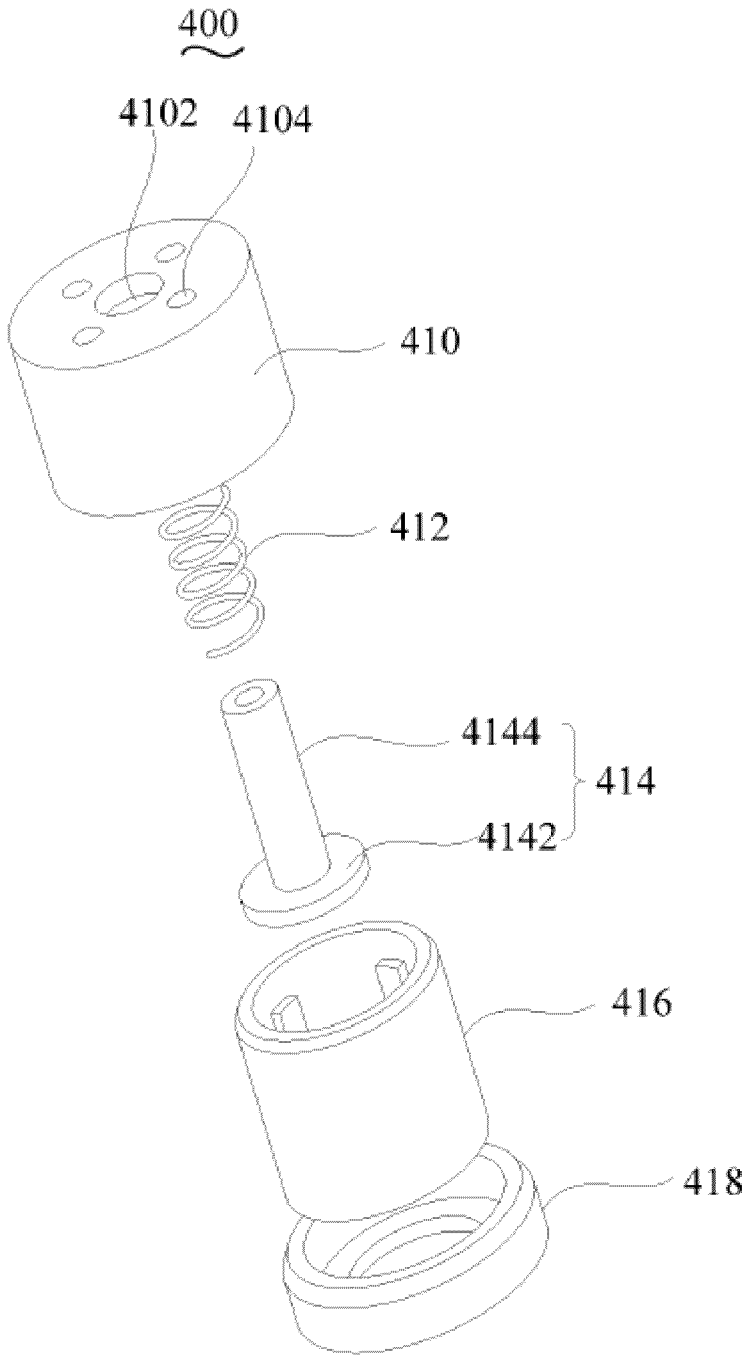
FIG. 2 is a segment diagram for a pressure-regulating valve component of the electronic cigarette of the first embodiment in the present invention.
Figure 3:
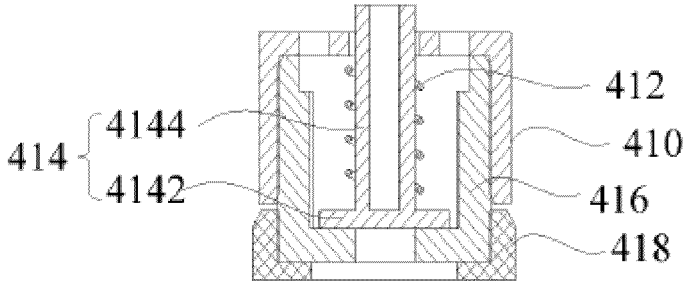
FIG. 3 is a sectional view of the overall structure of the pressure-regulating valve component of the electronic cigarette of the first embodiment in the present invention.
Figure 4:
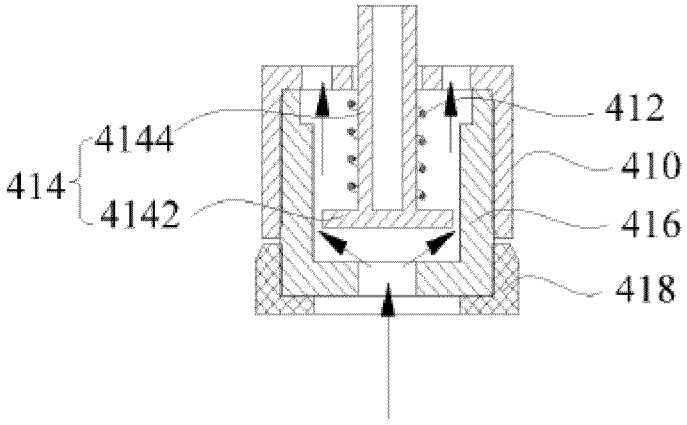
FIG. 4 is the air flow drawing when the pressure-regulating valve component of FIGS. 2 and 3 are in a smoking state.

As shown in FIGS. 2 to 4, the pressure-regulating valve component 400 can be a spring valve. The pressure-regulating valve component 400 comprises a first valve gland 410, a elastic part 412, a fixed part 414, a first support base 416 and a first sealing part 418. The elastic part 412 is installed on the bottom of the first valve gland 410, and winds along the fixed part 414, the fixed part 414 is set to the inside of the first support base 416, the both sides of the first sealing part 418 are butting connected with the first valve gland 410.

The first valve gland 410 is about hollow circular cylinder shaped, and one end of the first valve gland 410 is open, the other end is provided with several through-holes. In specific embodiments, the top of the first valve gland 410 is provided with five through-holes which comprise a larger through-hole 4102 located at the top centre and four smaller through-holes 4104 which are spread around the larger through-hole 4102, the purpose is to make the gas generated when smoking enter the atomizer 300 from the smaller through-holes 4104. Understandably, the shape of the through-hole has no specific limitation, it can be circular, square, or other shapes, in the embodiment the shape of the through-hole is circular.

The elastic part 412 is fixed on the inner of the first valve gland 410, and is corresponding to the larger through-hole 4102 of the top of the first valve gland 410. In the embodiment, the elastic part 412 can be a coil spring, of course, can be other mechanical parts which have the property of elasticity.

The fixed part 414 comprises a base 4142 and a body 4144. The base 4142 is circular, the body 4144 is perpendicular to the base 4142 and is located on the middle of the base 4142. In the embodiment, the body 4144 is hollow circular cylinder shaped, the elastic part 412 winds along the outside of the body 4144, and the body 4144 can stretch out a certain distance from the larger through-hole 4102 of the first valve gland 410, and is butting fixed with the both sides of the inner wall of the larger through-hole 4102.

The first support base 416 is cylindrical shape and the both ends are open. The inside of the first support base 416 is provided with several bulges apart from each other, the bulges are cuboid, the base 4142 of the fixed part 414 is set to the bulges placed on the inside of the first support base 416.

The first sealing part 418 is also hollow circular cylinder shaped, the diameter of the first sealing part 418 is slightly larger than the first support base 416, and it is preferably that the first support base 416 should be placed in the inner of the first sealing part 418 at the right moment. The both ends of the first sealing part 418 are open, wherein the bottom opening of the first sealing part 418 is a inflow-port for the gas.

In the embodiment, when assembling the pressure-regulating valve component 400, the first support base 416 is placed in the hollow interior of the first sealing part 418, the opening of the bottom of the first sealing part 418 is corresponding to the opening of the first support base 416, then the fixed part 414 is set to the bulges placed on the inside of the first support base 416, and specifically the base 4142 of the fixed part 414 is set to the bulges placed on the inside of the first support base 416, finally the elastic part 412 of the first valve gland 410 connected with the elastic part 412 winds along the body 4144 of the fixed part 414, the pressure-regulating valve component 400 with elastic is obtained. Due to the existence of the pressure-regulating valve component 400, it can control the flow of the smoke liquid of the electronic cigarette by adjusting the elastic force of the elastic part 414 and further adjust the amount of atomizing smoke liquid inhaled by people. So the electronic cigarette can improve the taste of smoking, satisfy different users' need.

FIG. 4 is the air flow drawing when the electronic cigarette comprising the pressure-regulating valve component 400 with the elastic part 412 is in a smoking state (the arrows represent direction of the air flow). In the embodiment, when the user begins to inhale gas through the cigarette holder 200, the fixed part 414 will be sucked up due to the role of the suction so that the base 4142 of the fixed part 414 is far away the fixed part 414, the smoke liquid enters the atomizer 300 for atomizing loop through the first sealing part 418, the first support base 416 and the smaller through-hole 4104 of the first valve gland 410. The electronic cigarette of the present invention can adjust the taste of smoking through change the elastic force of the elastic part 414, and can prevent the tobacco bar inflows from the battery and control panel to extend the life of the electronic cigarette.

Embodiment 2

Figure 5:
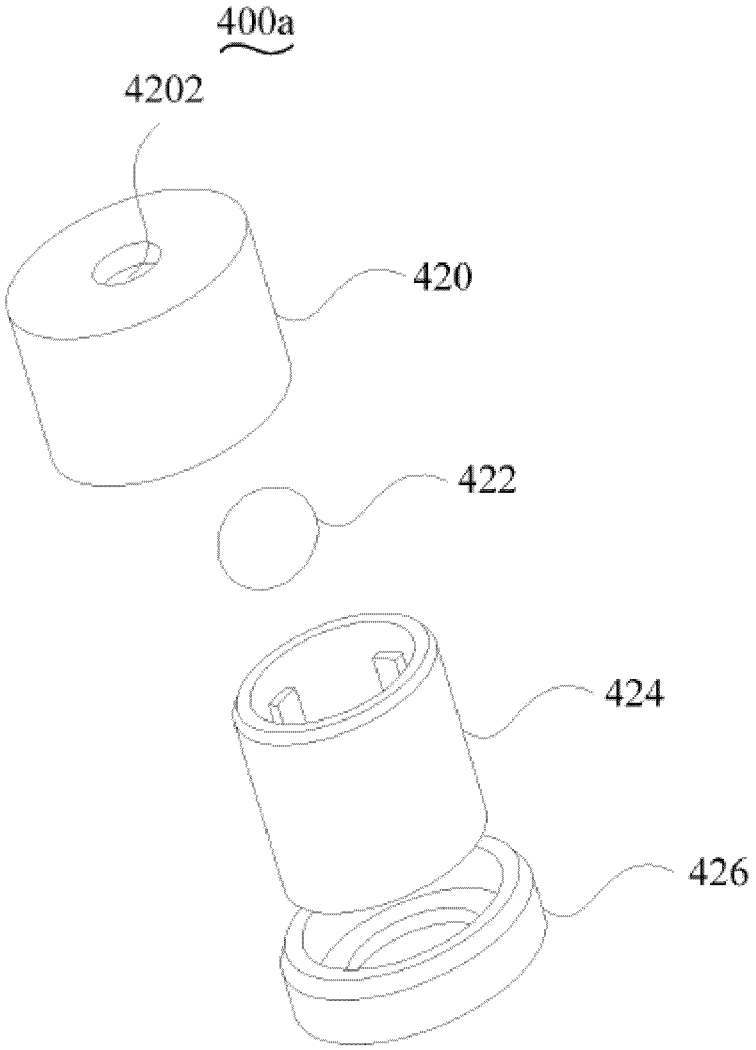
FIG. 5 is a segment diagram of the pressure-regulating valve component of the electronic cigarette of the second embodiment in the present invention.
Figure 6:
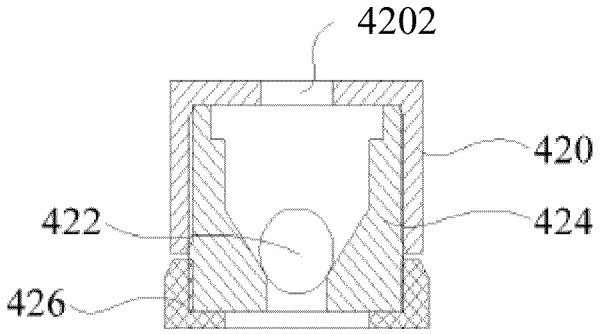
FIG. 6 is a sectional view of the overall structure of the pressure-regulating valve component of the electronic cigarette of the second embodiment in the present invention.
Figure 7:
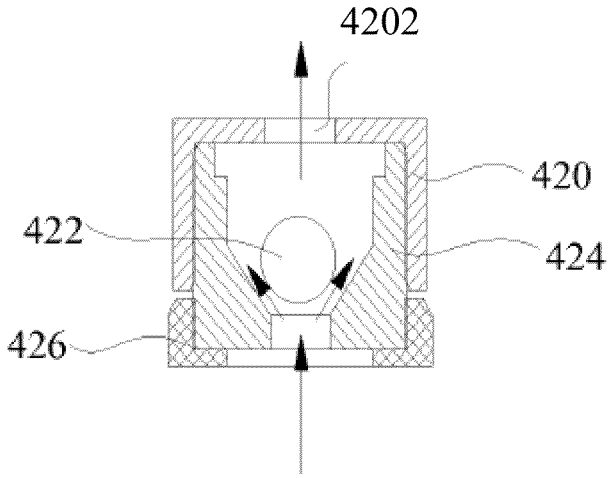
FIG. 7 is the air flow drawing when the pressure-regulating valve component of FIGS. 5 and 6 are in a smoking state.

As shown in FIGS. 5 to 7, an electronic cigarette is provided in the second embodiment of the present invention. The electronic cigarette of the second embodiment differs from the first embodiment only in using other pressure-regulating valve component 400*a* instead of the above pressure-regulating valve component 400, so the structure of the pressure-regulating valve component 400*a* is shown in FIGS. 5 to 7. Other components that are the same with the above electronic cigarette 10 will be not shown. The pressure-regulating valve component 400*a* comprises the second valve gland 420, a steel ball 422, the second support base 424 and the second sealing part 426. The steel ball 422 is set to the inner of the second support base 424, the second sealing part 426 is butting connected with the second valve gland 420 going through the second support base 424.

The second valve gland 420 is about hollow circular cylinder shaped, and one end of the second valve gland 420 is open, the other end is provided with a through-hole 4202, the through-hole 4202 is used to make the gas generated when smoking enter the atomizer 300. Understandably, the shape of the through-hole 4202 has no specific limitation, it can be circular, square, or other shapes, in the embodiment the shape of the through-hole is circular.

The second support base 424 is about cylindrical shape and the both ends are open, the diameter of the second base 424 is slightly smaller than the second valve gland 420 and it is preferably that the second support base 424 is encapsulated in the second valve gland 420. The inside of the second support base 424 is provided with several bulges apart from each other, the bulges are cuboid.

The steel ball 422 is hollow, and the weight of the steel ball 422 should not be overweight, otherwise, the steel ball 422 cannot be sucked up. In the embodiment, it is preferably that the size of the steel ball 422 is set to the inside of the second support base 424, and the through-hole 4202 of the second support base 424 is corresponding to the steel ball 422.

The second sealing part 426 is also hollow circular cylinder shaped, the diameter of the second sealing part 426 is slightly larger than the second support base 424, and it is preferably that the second support base 424 should be placed in the inner of the second sealing part 426 at the right moment. The both ends of the second sealing part 426 are open, wherein the bottom opening of the second sealing part 426 is a inflow-port for the gas.

In the embodiment, when assembling the pressure-regulating valve component 400*a*, the second support base 424 is placed in the hollow interior of the second sealing part 426, the opening of the bottom of the second sealing part 426 is corresponding to the opening of the second support base 424, then the steel ball 422 is set to the bulges placed on the inside of the second support base 424, finally the second valve gland 420 is coated outside of the second support base 424, and is butting connected with the second sealing part 426, the pressure-regulating valve component 400*a* is obtained.

FIG. 7 is the air flow drawing when the electronic cigarette comprising the pressure-regulating valve component 400*a* with the steel ball 422 is in a smoking state (the arrows represent direction of the air flow). In the embodiment, when the user begins to inhale gas through the cigarette holder 200, the steel hall 422 will be sucked up due to the role of the suction, so the smoke liquid enters the atomizer 300 for atomizing loop through the second sealing part 426, the second support base 424 and the through-hole 4202 of the second valve gland 420. The electronic cigarette of the present invention can adjust the taste of smoking through change the weight and size of the steel ball 422, and can prevent the tobacco bar inflows from the battery and control panel to extend the life of the electronic cigarette.

Embodiment 3

Figure 8:
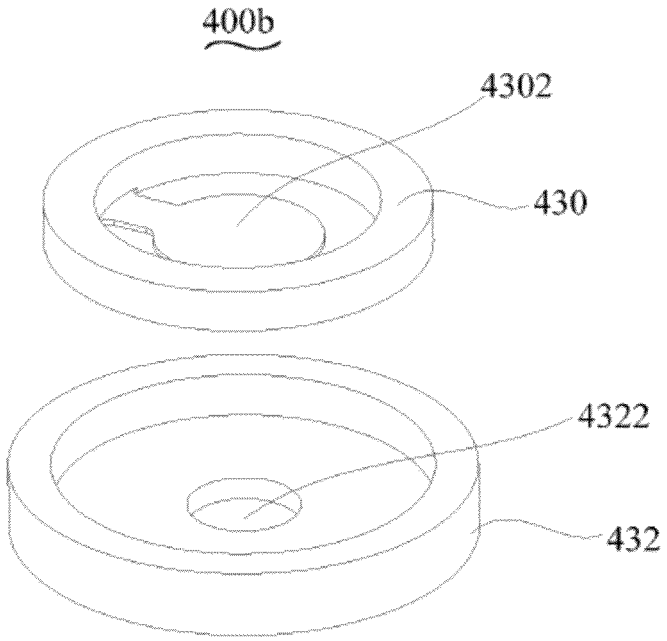
FIG. 8 is a segment diagram of the pressure-regulating valve component of the electronic cigarette of the third embodiment in the present invention.
Figure 9:
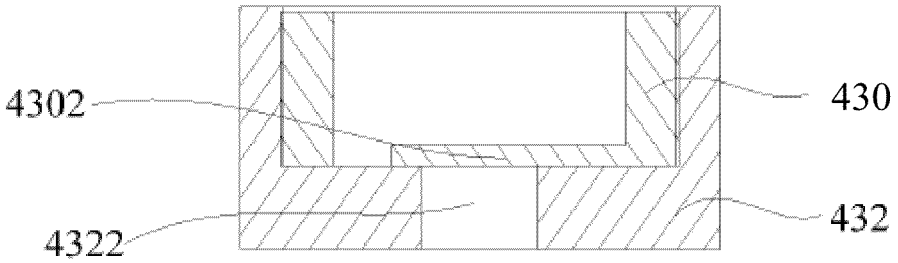
FIG. 9 is a sectional view of the overall structure of the pressure-regulating valve component of the electronic cigarette of the third embodiment in the present invention.
Figure 10:
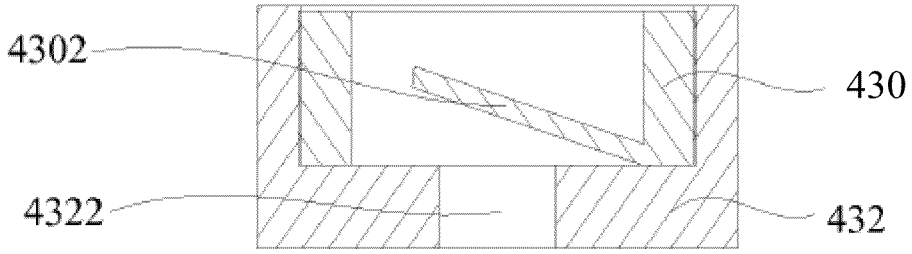
FIG. 10 is the air flow drawing when the pressure—regulating valve component of FIGS. 8 and 9 are in a smoking state.

As shown in FIGS. 8 to 10, an electronic cigarette is provided in the third embodiment of the present invention. The electronic cigarette of the third embodiment differs from the first embodiment only in using other pressure-regulating valve component 400*b* instead of the above pressure-regulating valve component 400, so the structure of the pressure-regulating valve component 400*b* is shown in FIGS. 8 to 10. Other components that are the same with the above electronic cigarette 10 will be not shown. The pressure-regulating valve component 400*b* the third support base 432 and the third valve 430, the third valve 430 is sleeved on the inner of the third support base 432.

The third support base 432 is cylindrical, and one end of the third support base 432 is open, the other end is provided with through-hole 4322. The diameter of the third support base 432 is slightly larger than the third valve 430, and it is preferably that the third valve 430 is sleeved on the inner of the third support base 432.

The third valve 430 is cylindrical, and one end of the third valve 430 is open, the other end is provided with opening which is corresponding to the through-hole 4322. The inside of the third valve 430 is provided with a connecting part 4302, the connecting part 4302 is connected to the edge of the third valve 430, and is corresponding to the through-hole 4322, so the connecting part 4302 can be kicked up freedom by the role of external force. In the embodiment, the connecting part 4302 can be round thin sheet, of course, it can be other shapes such as squares. The connecting part 4302 is prepared by using the silicone or other lightweight materials.

In the embodiment, when assembling, the pressure-regulating valve component 400*b*, the third valve 430 provide with the connecting part 4302 is placed in the interior of the third support base 432, and the through-hole 4322 of the third support base 432 is corresponding to the connecting part 4302 of the third valve 430. As shown in FIG. 10, the electronic cigarette comprising the pressure-regulating valve component 400*b* with the connecting part 4302 is in a smoking state. In the embodiment, when smoking the one end of the connecting part 4302 is kicked up due to the role of suction, so the smoke liquid enters the atomizer 300 through the through-hole 4322 of the third support base 432. The electronic cigarette of the present invention can adjust the taste of smoking through change the weight of the connecting part 4302, and can prevent the tobacco bar inflows from the battery and control panel to extend the life of the electronic cigarette.

When implementing the electronic cigarette 10 of the present invention, the following advantageous effects can be achieved: since between the cigarette rod 100 and the atomizer 300 is installed with the pressure-regulating valve component 400, the pressure-regulating valve component 400 can control the flow of the smoke liquid of the electronic cigarette, and further adjust the amount of atomizing smoke liquid inhaled by people. So the electronic cigarette can adjust the taste of smoking, satisfy different users' need, and can prevent the tobacco bar inflows from the battery and control panel to extend the life of the electronic cigarette.

While the embodiments of the present invention are described with reference to the accompanying drawings above, the present invention is not limited to the above-mentioned specific implementations. In fact, the above-mentioned specific implementations are intended to be exemplary not to be limiting. In the inspiration of the present invention, those ordinary skills in the art can also make many modifications without breaking away from the subject of the present invention and the protection scope of the claims. All these modifications belong to the protection of the present invention.

The invention claimed is:

1. An electronic cigarette, comprising a cigarette rod (100) with smoke liquid and a battery, a cigarette holder (200), a atomizer (300), a pressure-regulating valve component (400) provided between the cigarette rod (100) and the atomizer (300) to adjust flow of the smoke liquid, a first support (500) and a second support (600), wherein the cigarette rod (100), the atomizer (300) and the cigarette holder (200) are connected successively, the battery provides power for the atomizer (300) to heat and atomize the smoke liquid, atomized smoke liquid is discharged through the cigarette holder (200), and the pressure-regulating valve component (400) is fixed with the cigarette rod (100) and the atomizer (300) respectively through the first support (500) and the second support (600); and wherein the pressure-regulating valve component (400) comprises a first valve gland (410), an elastic part (412) installed on bottom of the first valve gland (410), a fixed part (414) wound by the elastic part (412) and a first support base (416) for supporting the fixed part (414); the first valve gland (410) is provided with at least two through-holes; both ends of the first support base (416) are open, inside of the first support base (416) is provided with at least two bulges apart from each other, and the fixed part (414) is set to the bulges placed on the inside of the first support base (416).

2. The electronic cigarette according to claim 1, wherein, the fixed part (414) comprises a base (4142) and a body (4144) perpendicular to the base (4142), the base (4142) is set to the bulges placed on the inside of the first support base (416), and the elastic part (412) winds along outside of the body (4144).

3. The electronic cigarette according to claim 1, wherein, the pressure-regulating valve component (400) also comprises a first sealing part (418), both sides of the first sealing part (418) are butting connected with the first valve gland (410), and both ends of the first sealing part (418) are open.

4. The electronic cigarette according to claim 2, wherein, the body (4144) is inserted into a through-hole of the first valve gland (410), and is butting fixed with both sides of inner wall of the through-hole.

* * * * *